US011577528B1

(12) United States Patent
Ferrara, Jr. et al.

(10) Patent No.: US 11,577,528 B1
(45) Date of Patent: Feb. 14, 2023

(54) SYSTEM AND METHOD FOR ADJUSTING A PRINTHEAD TO MEDIA GAP IN AN INKJET PRINTER

(71) Applicant: Xerox Corporation, Norwalk, CT (US)

(72) Inventors: Joseph M. Ferrara, Jr., Webster, NY (US); Christopher D. Atwood, Rush, NY (US); Joseph F. Casey, Webster, NY (US); Frank B. Tamarez Gomez, Webster, NY (US); Jacob R. McCarthy, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 12 days.

(21) Appl. No.: 17/458,931

(22) Filed: Aug. 27, 2021

(51) Int. Cl.
*B41J 11/20* (2006.01)
*B41J 25/308* (2006.01)
*B41J 13/12* (2006.01)

(52) U.S. Cl.
CPC ..... *B41J 11/20* (2013.01); *B41J 13/12* (2013.01); *B41J 25/308* (2013.01)

(58) Field of Classification Search
CPC ..... B41J 11/20; B41J 13/12; B41J 25/308
See application file for complete search history.

(56) References Cited

U.S. PATENT DOCUMENTS

| | | | | |
|---|---|---|---|---|
| 6,076,909 | A * | 6/2000 | Saeki | B41J 25/3082 347/8 |
| 6,561,606 | B1 * | 5/2003 | Yoshida | B41J 25/3086 400/58 |
| 6,721,070 | B1 | 4/2004 | Lee et al. | |
| 8,757,746 | B2 | 6/2014 | Wing et al. | |
| 8,888,212 | B2 | 11/2014 | MacKenzie et al. | |
| 9,248,645 | B1 | 2/2016 | Mandel et al. | |
| 9,309,074 | B1 | 4/2016 | Bonino et al. | |
| 9,440,459 | B1 | 9/2016 | Fromm et al. | |
| 9,527,320 | B2 | 12/2016 | Shelhart et al. | |
| 2017/0305145 | A1 * | 10/2017 | Kyoso | B41J 2/0458 |

* cited by examiner

*Primary Examiner* — Henok D Legesse
(74) *Attorney, Agent, or Firm* — Maginot Moore & Beck LLP

(57) ABSTRACT

A method of operating a printer compares print job parameters for a current print job to be printed by the printer to a database of print job parameters for previously performed print jobs to identify media issues that may be caused by printing the current print job at a nominal printhead/media transport path distance. The gap between the printheads and the media transport is adjusted for identified media issues. Additionally, the method evaluates the image data content of the current print job to identify media issues that may arise from the printing of each sheet in the print job. If media issues are identified from the image data content, then the gap between the printheads and the media transport is further adjusted for sheets corresponding to the identified media issues caused by the image data content. An inkjet printer capable of being operated in this manner is also disclosed.

24 Claims, 9 Drawing Sheets

SYSTEM AND METHOD FOR ADJUSTING A PRINTHEAD TO MEDIA GAP IN AN INKJET PRINTER

TECHNICAL FIELD

This disclosure relates generally to devices that produce ink images on media, and more particularly, to adjustment of the printhead to media gap in such devices.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image data used to generate the firing signals. The image receiving member can be a continuous web of media material or a series of media sheets.

A distance between the printheads in the printhead array and the surface of the image receiving member is carefully selected to optimize the imaging process. If the gap is too small, the image receiving member can burnish the face of the printheads. Burnishing not only reduces the life of the printheads, but results in poor image quality, unintentional markings, and increased downtime of the printer during maintenance. If the gap is too large, image quality suffers, particularly in high speed printers, since a large gap can affect the accuracy of the ejected ink drops landing on the image receiving member to form the printed image. Thus, the setting of a gap distance between a printhead and an image receiving member is an important parameter affecting image quality in an inkjet printer. A nominal gap distance between printheads and an image receiving surface for typically used media can be, for example, about 1 mm or less. As used in this document, the term "nominal printhead/media gap distance" means the smallest distance between a printhead and an upper surface of media being printed without causing print job faults arising from media issues.

Some types of media have a tendency to wrinkle when they are printed with high ink coverage areas because the amount of solvent that they absorb from the ejected ink distends the media surface. The threshold for what constitutes a high ink coverage area is lower for thinner media than it is thicker media. Coatings on papers also alter the response of the media to ink absorption. Additionally, the types of ink used for printing affect the amount of solvent absorbed by media. Distended media has an unpredictable effect on printhead face to media gap during a print job.

Previously known printers have included a sheet height sensor that generates a signal when a height of the media exceeds a height for a currently set printhead/media surface gap. The printhead array, the media transport, or both can be repositioned with actuators in response to height sensor signal to maintain a sufficient gap distance so that distended media does not impact the printhead. Adjusting the printhead/media surface gap in response to a real time height sensor signal, however, is extremely difficult in high speed printers. Therefore, being able to evaluate the probability of gap distances occurring during a print job that could have adverse impacts on the printheads and the image quality before a print job commences would be beneficial.

SUMMARY

An inkjet printer is configured to evaluate the probability of gap distances occurring during a print job that could have adverse impacts on the printheads and the image quality and to adjust the gap distance between printheads and the ink receiving surface of media being printed to compensate for high probability adverse impacts. The printer includes a database in which records corresponding to previously performed print jobs by the inkjet printer are stored, at least one printhead, a media transport path that is configured to carry media past the at least one printhead for printing ink images on the media, and a controller operatively connected to the database. The controller is configured to: receive print job parameters for a print job to be printed by the inkjet printer, compare the received print job parameters with print job parameters stored in the records of the database, retrieve records from the database that have at least one print job parameter that corresponds to at least one of the received print job parameters, and adjust a gap between at least one printhead and a media transport path in the printer using a printhead/media gap distance stored in the retrieved record.

A method of operating an inkjet printer evaluates the probability of gap distances occurring during a print job that could have adverse impacts on the printheads and the image quality and adjusts the gap distance between printheads and the ink receiving surface of media being printed to compensate for high probability adverse impacts. The method includes receiving print job parameters for a print job with a controller, comparing with the controller the received print job parameters with print job parameters stored in records corresponding to previously performed print jobs that are stored in a database, retrieving records from the database that have at least one print job parameter that corresponds to at least one of the received print job parameters, and adjusting a gap between at least one printhead and a media transport path in the printer using a printhead/media gap distance stored in the retrieved record.

BRIEF DESCRIPTION OF THE DRAWINGS

The foregoing aspects and other features of a printer and printer operational method that evaluates the probability of media problems during a print job and adjusts the gap distance between printheads and the ink receiving surface of media being printed to compensate for high probability adverse impacts are explained in the following description, taken in connection with the accompanying drawings.

DETAILED DESCRIPTION

Figure 1:
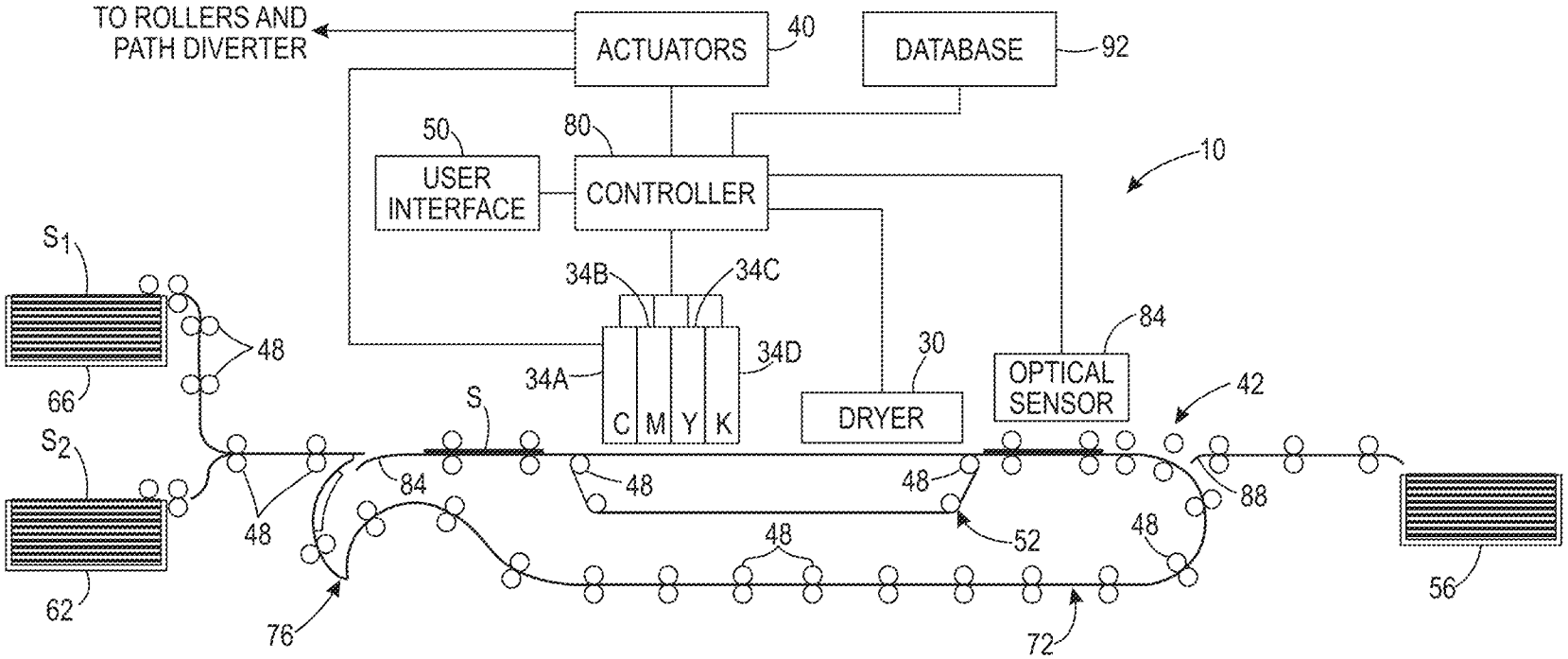
FIG. 1 is a schematic drawing of an inkjet printer that adjusts the gap distance between printheads and the ink receiving surface of media being printed to compensate for the high probability of media problems during a print job.

For a general understanding of the environment for the printer and printer operational method disclosed herein as well as the details for the printer and the printer operational method, reference is made to the drawings. In the drawings, like reference numerals have been used throughout to designate like elements. As used herein, the word "printer" encompasses any apparatus that ejects ink drops onto different types of media to form ink images. The term "process direction" means the direction in which media sheets move past the printheads as the inkjets eject ink onto the sheets and the term "cross-process direction" means an axis that is perpendicular to the process direction in the plane of a media sheet passing the printheads.

FIG. 1 illustrates a high-speed inkjet image producing machine or printer 10 in which a controller 80 has been configured to perform the process 700 described below to evaluate the probability of a media issue during a print job and to adjust the printhead/media gap distance to attenuate the media issue. As illustrated, the printer 10 is a printer that directly forms an ink image on a surface of a media sheet stripped from one of the supplies of media sheets $S_1$ or $S_2$ and the sheets S are moved through the printer 10 by the controller 80 operating one or more of the actuators 40 that are operatively connected to rollers or to at least one driving roller of conveyor 52 that comprise the media transport 42. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction. Although printer 10 is depicted with only two supplies of media sheets, the printer can be configured with three or more sheet supplies, each containing a different type and size of media.

Figure 2:
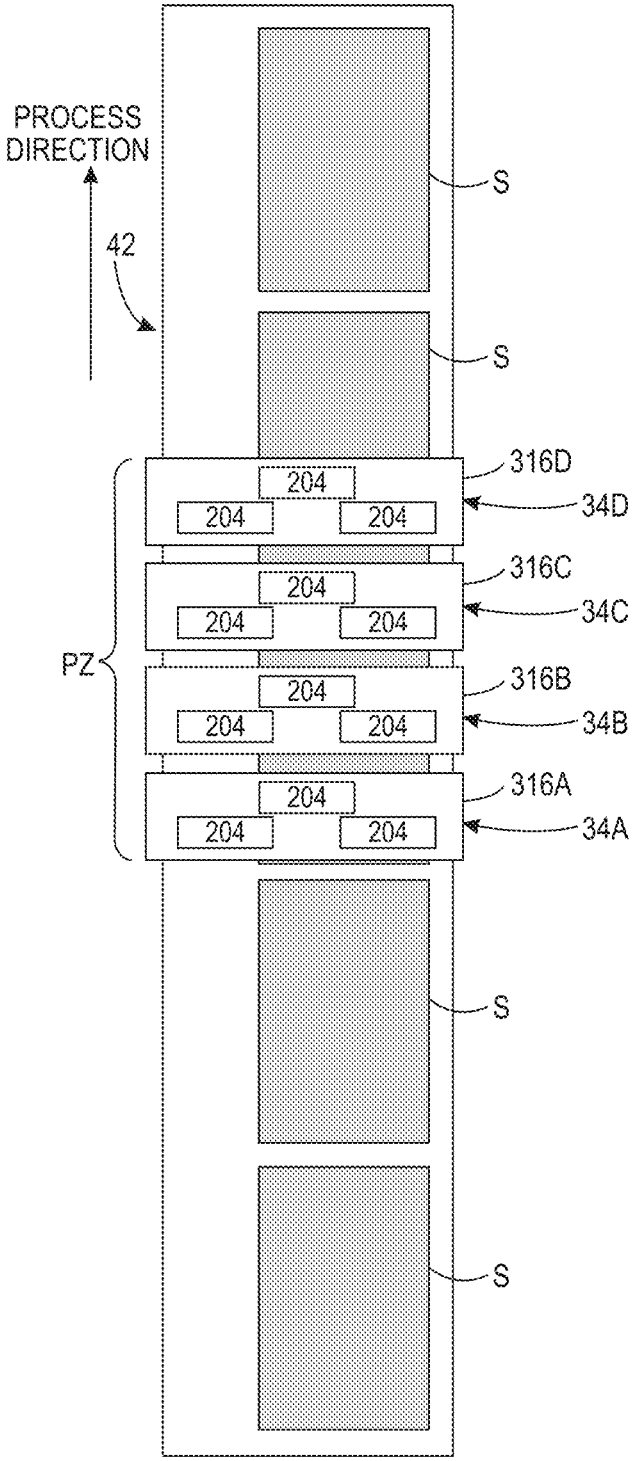
FIG. 2 illustrates a print zone in the printer of FIG. 1.

The print zone PZ is shown in FIG. 2. The print zone PZ has a length in the process direction commensurate with the distance from the first inkjets that a sheet passes in the process direction to the last inkjets that a sheet passes in the process direction and it has a width that is the maximum distance between the most outboard inkjets on opposite sides of the print zone that are directly across from one another in the cross-process direction. Each printhead module 34A, 34B, 34C, and 34D shown in FIG. 2 has three printheads 204 mounted to a printhead carrier plate 316A, 316B, 316C, and 316D, respectively. Actuators are configured to move the carrier plates with respect to the media transport 42 as discussed more fully below to adjust the distance between the printheads on a carrier plate and the media transport to attenuate media issues identified as being probable during a print job.

As shown in FIG. 1, the printed image passes under an image dryer 30 after the ink image is printed on a sheet S. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

A duplex path 72 is provided to receive a sheet from the transport system 42 after a substrate has been printed and move it by the rotation of rollers in an opposite direction to the direction of movement past the printheads. At position 76 in the duplex path 72, the substrate is turned over so it can merge into the job stream being carried by the media transport system 42. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 1, a substrate from media transport 42 is diverted to the duplex path 72. Rotating the pivoting member 88 in the clockwise direction from the diverting position closes access to the duplex path 72 so substrates on the media transport continue moving to the receptacle 56. Another pivoting member 84 is positioned between position 76 in the duplex path 72 and the media transport 42. When controller 80 operates an actuator to rotate pivoting member 84 in the counterclockwise direction, a substrate from the duplex path 72 merges into the job stream on media transport 42. Rotating the pivoting member 84 in the clockwise direction closes the duplex path access to the media transport 42.

As further shown in FIG. 1, the printed media sheets S not diverted to the duplex path 72 are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80, which is configured to determine which inkjets, if any, that were operated to eject ink did in fact do so or if they did not eject an ink drop having an appropriate mass or that landed errantly on the sheet. Any inkjet operating in this manner is called an inoperative inkjet in this document. The controller can store data identifying the inoperative inkjets in a memory operatively connected to the controller. A user can operate the user interface 50 to obtain reports displayed on the interface that identify the number of inoperative inkjets and the printheads in which the inoperative inkjets are located. The optical sensor can be a digital camera, an array of LEDs and photodetectors, or other devices configured to generate image data of a passing surface. As already noted, the media transport also includes a duplex path that can turn a sheet over and return it to the transport prior to the printhead modules so the opposite side of the sheet can be printed. While FIG. 1 shows the printed sheets as being collected in the sheet receptacle, they can be directed to other processing stations (not shown) that perform tasks such as folding, collating, binding, and stapling of the media sheets.

Operation and control of the various subsystems, components and functions of the machine or printer 10 are performed with the aid of a controller or electronic subsystem (ESS) 80. The ESS or controller 80 is operably connected to the components of the printhead modules 34A-34D (and thus the printheads), the actuators 40, and the dryer 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

Figure 3:
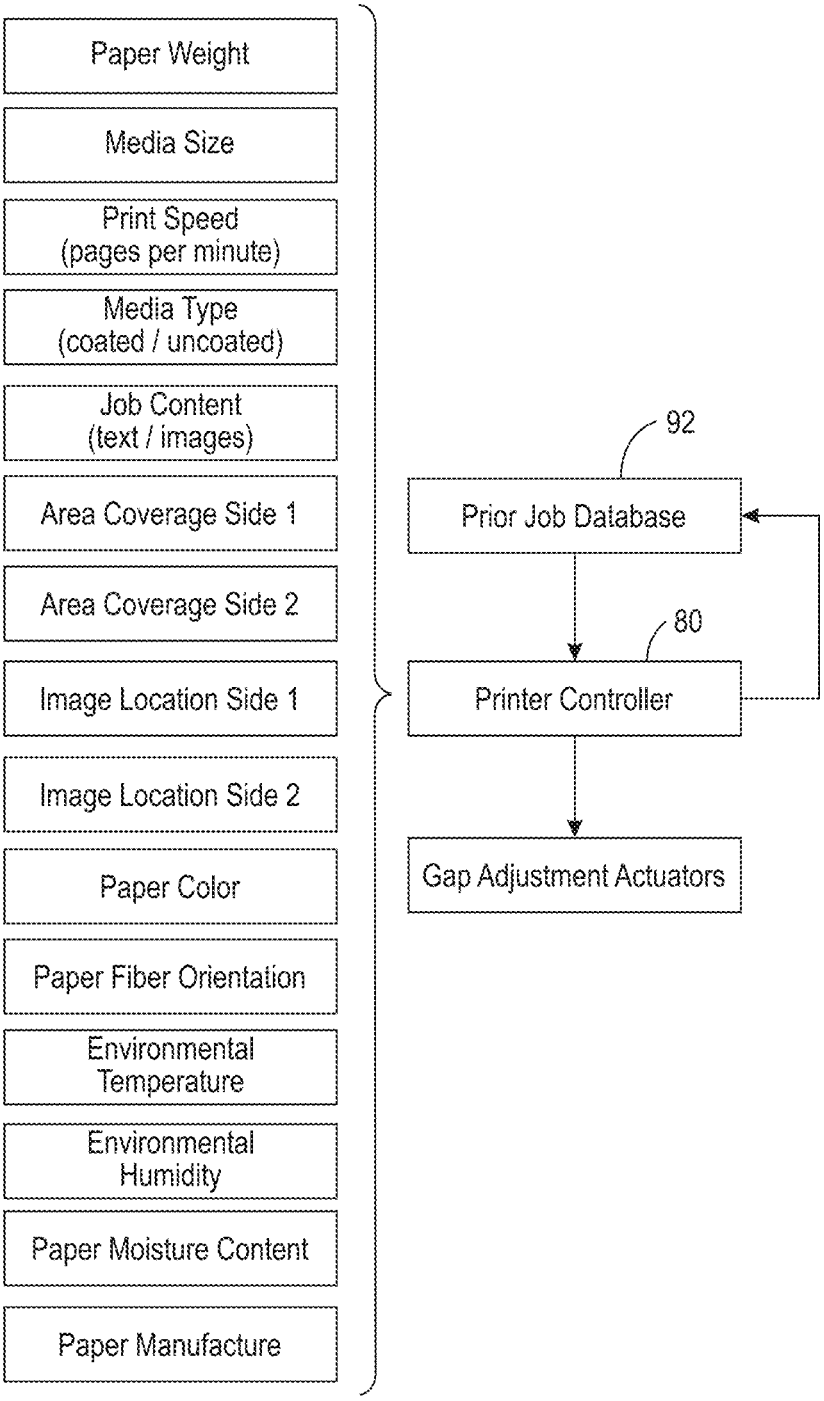
FIG. 3 depicts the print job parameters and image data provided to the controller of the printer in FIG. 1 that are used to evaluate the probability of media issues arising during a print job.

In operation, image data for an image to be produced are sent to the controller 80 from either a scanning system or an online or work station connection for processing and generation of the printhead control signals output to the printhead modules 34A-34D. Along with the image data, the controller receives print job parameters that identify the media weight, media dimensions, print speed, media type, ink area coverage to be produced on each side of each sheet, location of the image to be produced on each side of each sheet, media color, media fiber orientation for fibrous media, print zone temperature and humidity, media moisture content, and media manufacturer. These print job parameters and the image data, denoted as job content, are shown in FIG. 3. As used in this document, the term "print job parameters" means non-image content data for a print job.

Figure 4:
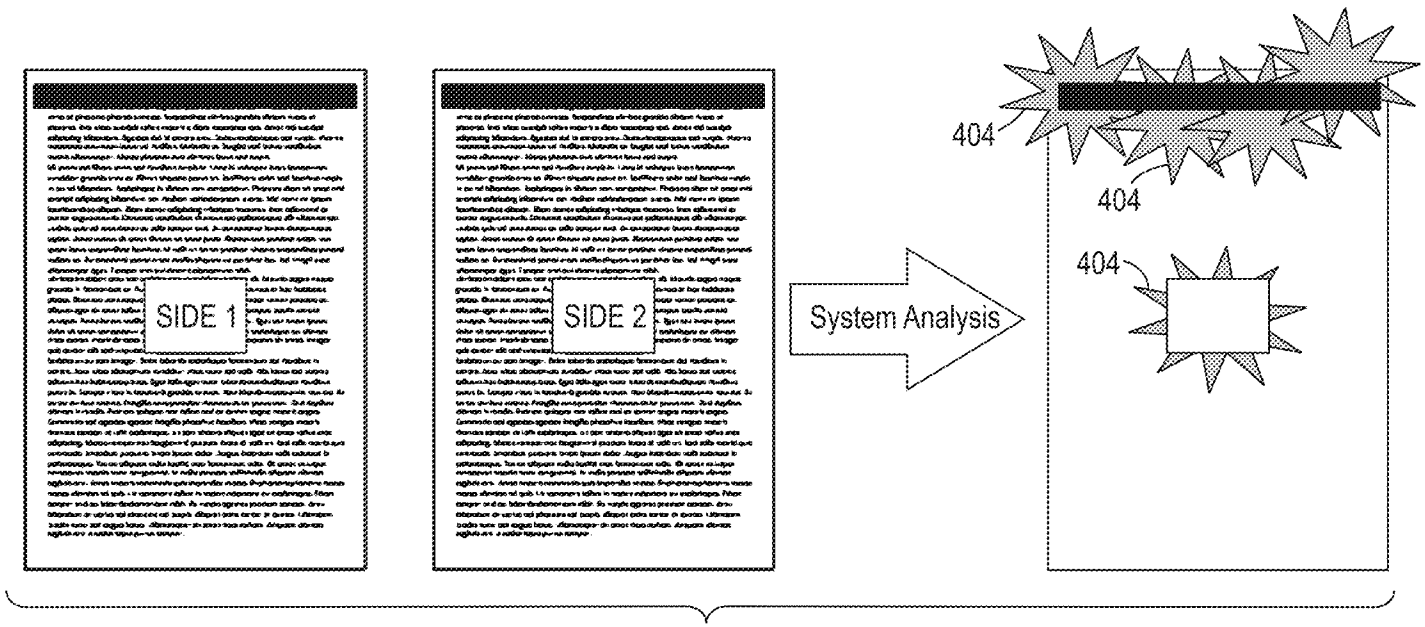
FIG. 4 depicts a printed image for two sides of a media sheet and the areas determined to be high risk areas for media wrinkle or cockle.

FIG. 4 illustrates an example of processing performed by processor 80 to evaluate probabilities of media issues during a print job caused by the content of the image data to be printed. Sheet 404A is text data to be printed on one side of a sheet and sheet 404B is text data to be printed on the opposite side of the sheet. Although this example uses only text data, the digital image data can include graphics and other types of image data. By determining the number of pixels that need to be printed, their positions, and the volumes of the drops to form the pixels on both sides of the sheet, the processor can determine the density of the ink coverage in sliding window areas on both sides of the sheet. If the density of any sliding window area exceeds a predetermined threshold for the type of media identified by the print job parameters, such as the highlighted areas 404 in the rightmost composite sheet, then the processor displays a message on the user interface 50 that indicates to the operator that a reasonable probability exists that wrinkle or cockle can occur if this sheet is printed using a nominal printhead/media gap. The operator can then select an option to have the gap adjusted so it is wider. The wider gap attenuates the effect of the media issue on the printheads at the expense of some diminishment of image quality. The wider gap does attenuate the quality of the image a bit but the print job does not have to be aborted for a media jam caused by wrinkle or cockle. In an alternative embodiment, the controller 80 detects the high coverage area and increases the gap immediately before the sheet on which the issue is likely to occur is printed during the print job and returns the gap to its nominal value after the sheet is printed.

Database 92 (FIG. 1) is derived empirically over time. Print jobs are printed by a printer and the print parameters are stored in the fields of a record. If media issues arise during the printing of the job that adversely impact image quality or that cause paper jams or the like, the issue is assigned a digital data identifier and stored in the database in association with the record in which the job parameters are stored. For example, if the image content data for a print job results in high coverage areas that produce media issues causing paper jams, then a paper jam digital data identifier is stored in association with the record in which the print job parameters are stored. Additionally, a print head/media gap distance that prevents the media issue from occurring is stored in the record with the media issue digital data identifier and the print job parameters. After a history of many jobs is compiled and stored in the database 92, the print job parameters for a current print job to be printed can be compared to the job parameter fields in the records of the database to determine the number of job parameters for the current print job that correspond to print job parameters stored in a record in the database. The record having the greatest number of common print job parameters is retrieved by the controller 80. The printhead/media gap distance stored in the record and the type of media identified by the current print job is used to set the printhead/media distance in the printer prior to commencement of the print job. As used in this document, the term "digital data identifier" means a binary number stored in a record of the database that identifies a problem affecting production of a print job when the print job is performed with at least one printhead in a printer being positioned at a nominal printhead/media gap distance during the print job. The printhead/media gap distance stored in a record of the database 92 is stored as a numerical measurement of the printhead/media gap distance, as a number of steps for a stepper motor to move from a nominal position of a printhead carrier plate, a number of rotations for a motor to move from a nominal position of the carrier plate, or other information that can be correlated to a numerical measurement of the distance between the printhead and the upper surface of media being printed or as an amount of movement from the nominal position of a printhead carrier plate.

In addition to print job parameters stored in a record, the controller 80 analyzes the image content data for the current job to determine whether media issues arise from the printing of any of the sheets in the print job. If media issues arise from the image data content, an alternative printhead/media gap distance for those sheets is identified and used to alter the printhead/media gap distance immediately prior to the printing of those sheets. The controller 80 can display a message that the printer is adjusting the printhead/media gap to avoid the likely media issue based on the print job parameters and that the gap will be further adjusted during the print job to attenuate the adverse effects that may be caused by printing some of the pages in the print job. The operator can select an adjustment override option if the operator wants to run the job using the nominal gap distance or the print job parameter media issue alone.

Figure 5A:
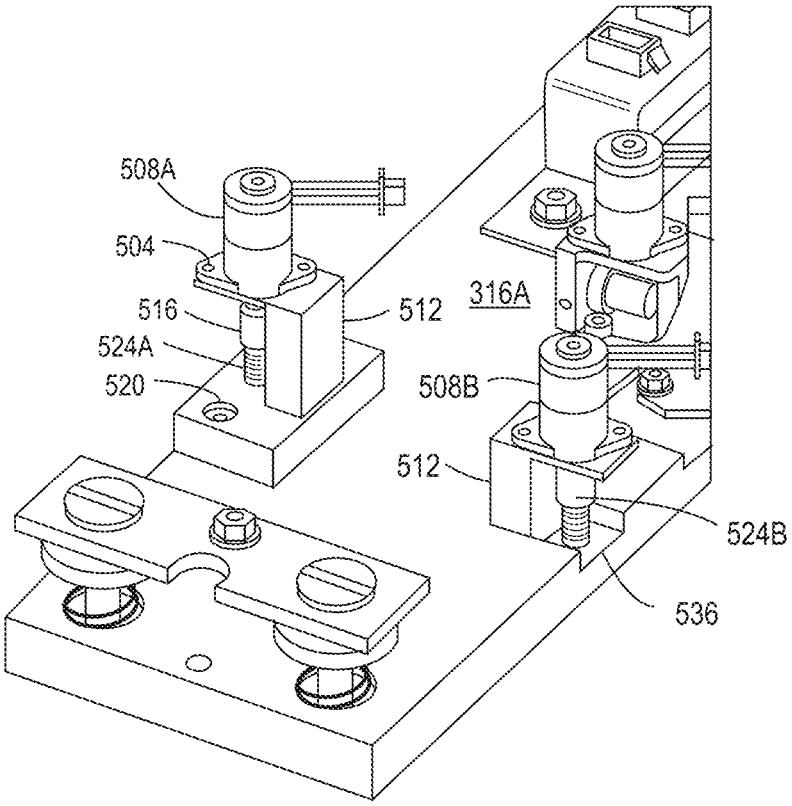
FIG. 5A shows a printhead carrier bar of FIG. 2 configured with actuators for adjusting a printhead-to-media gap in the printer of FIG. 1.
Figure 5B:
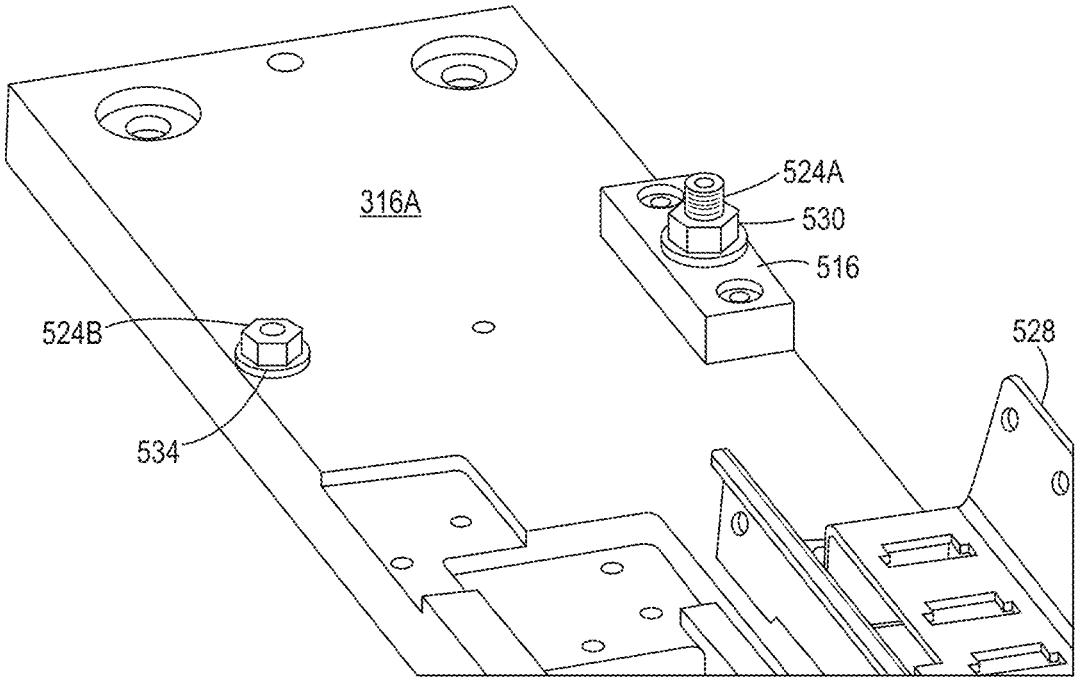
FIG. 5B shows the printhead carrier bar of FIG. 5A without the actuators.

As noted previously with respect to FIG. 2, each of the printhead modules 34A, 34B, 34C, and 34D has a carrier plate 316A, 316B, 316C, and 316D on which the printheads 204 of each module are mounted. One or more actuators are also mounted to each carrier plate in each printhead module. These actuators are configured to move the carrier plate and the printheads toward and away from the media transport 42 in the printer to adjust the gap between the printheads and the media passing by the printheads. As shown in FIG. 5A, a flange 504 of an actuator 508A is mounted to a L-shaped bracket 512 that extends from a base block 516. The base block 516 is mounted to the carrier plate 316A by a pair of threaded members 520 (FIG. 5B). A fine pitch screw 524A is operatively connected to the actuator 508A. In FIG. 5A, the actuator 508A is a stepper motor and the fine pitch screw 524A is configured with eighty threads per inch to provide highly accurate positioning of the carrier plate and printheads with respect to the media path. In the embodiment shown in FIG. 5A, a second actuator 508B is mounted to a second L-shaped bracket 512 that has one end of the bracket positioned with a recess 536. Again, the second actuator 508B drives a fine pitch screw 524B that has a different terminal end than the fine pitch screw 524A as discussed below.

Figure 5C:
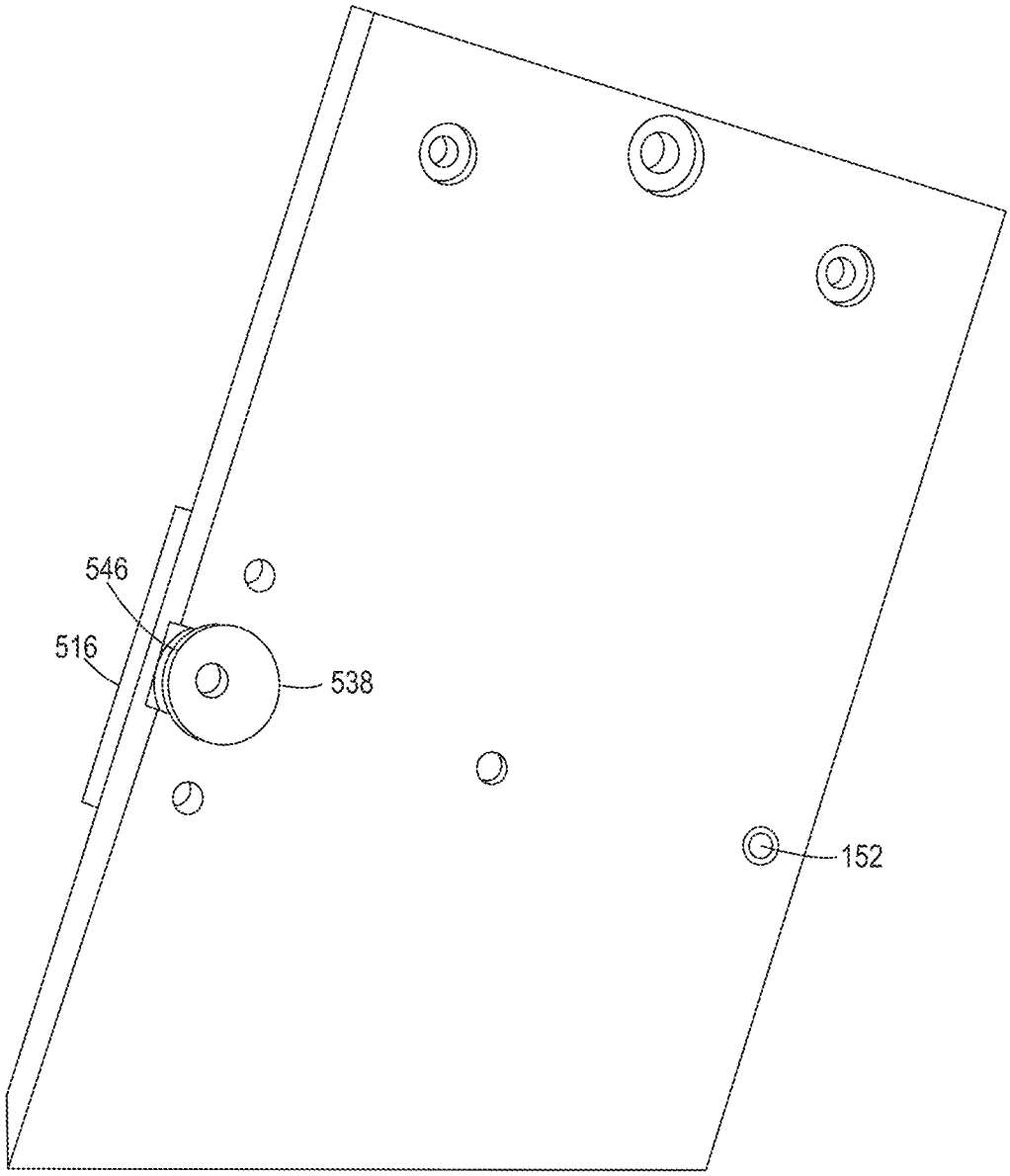
FIG. 5C shows an opposite side of the printhead carrier plate of FIG. 5A and FIG. 5B.

FIG. 5B depicts the same side of the carrier plate 316A as FIG. 5A but the actuators 508A and 508B have been removed to show the attachment of the two fine pitch screws 524A and 524B. The terminal end of screw 524A is held by nut 530 to base block 516, which is mounted to the carrier plate 316A by two threaded members 520 received within threaded holes in the carrier plate 316 underneath the base block. Screw 524B is received within a threaded nut 534, which is mounted to the carrier plate 316A. Bracket 528 is configured to receive a printhead. FIG. 5C depicts the opposite side of the carrier plate 316A. A conical receiver 538 is attached to the terminal end of the screw 524A that has passed through the base block 516 and the carrier plate 316A. The conical receiver 538 slides into a recess 546 in the carrier plate 316A for installation. Rounded nut 542 receives the end of screw 524B to hold that screw against the carrier plate. The conical receiver 538 constrains movement of the carrier plate in the X, Y, and Z axes, where X and Z are orthogonal within the plane of the carrier plate and the Y axis is perpendicular to the surface of the carrier plate. The rounded nut 542 constrains the movement of the carrier plate in the Y axis only.

Figure 6:
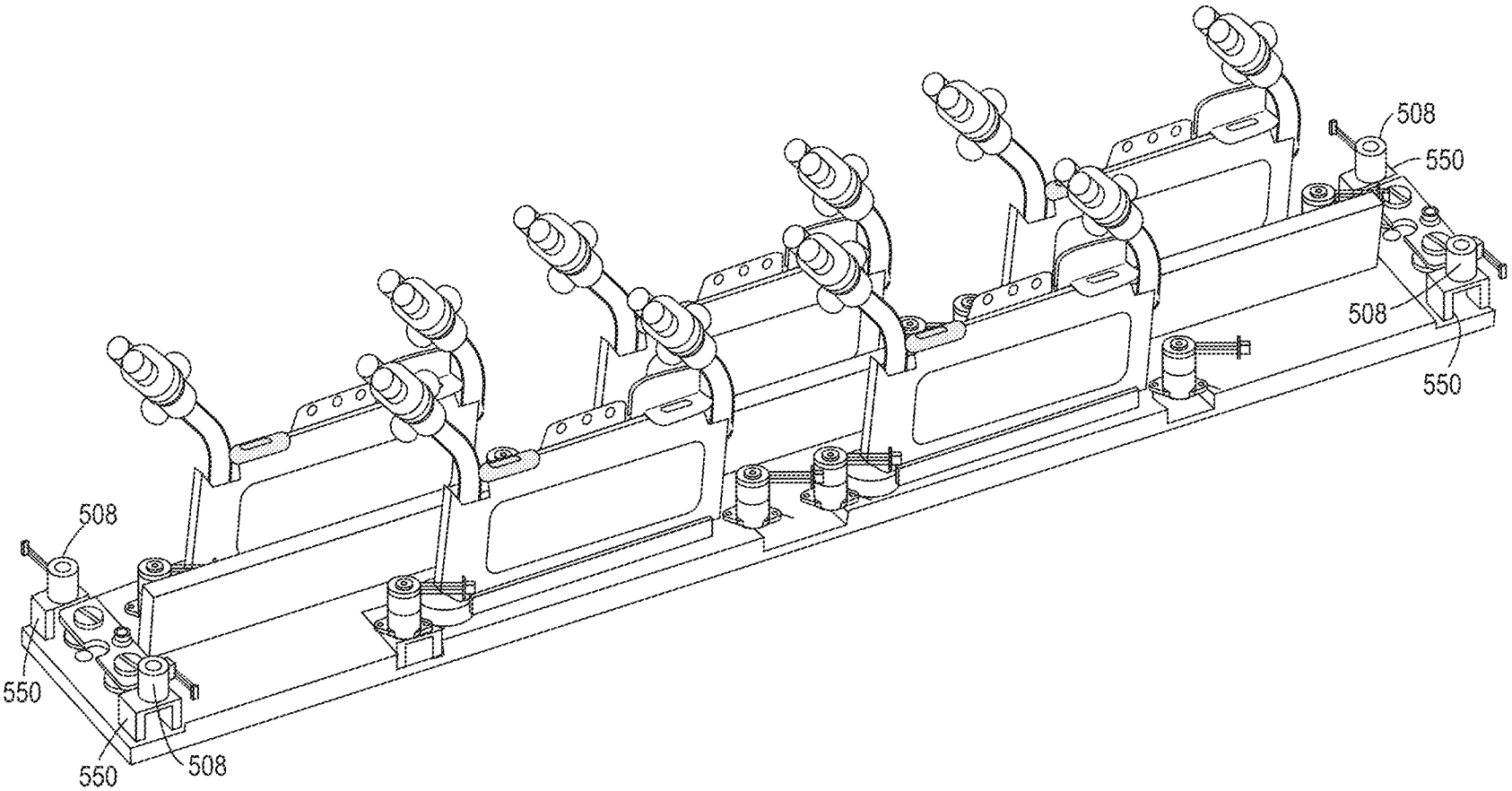
FIG. 6 depicts an alternative embodiment of a printhead carrier plate that can adjust the printhead-to-media gap.

An alternative embodiment of a carrier plate configured for gap adjustment movement is shown in FIG. 6. In this embodiment, an actuator 508 is mounted to a U-shaped bracket 550 extending from the carrier plate at each corner of the carrier plate. Controller 80 synchronizes the operation of these actuators 508 to move the carrier plate. Fewer or more actuators can be mounted to the plate for moving the printheads depending upon the number of printheads carried by the plate and the mass of the plate.

Figure 7:
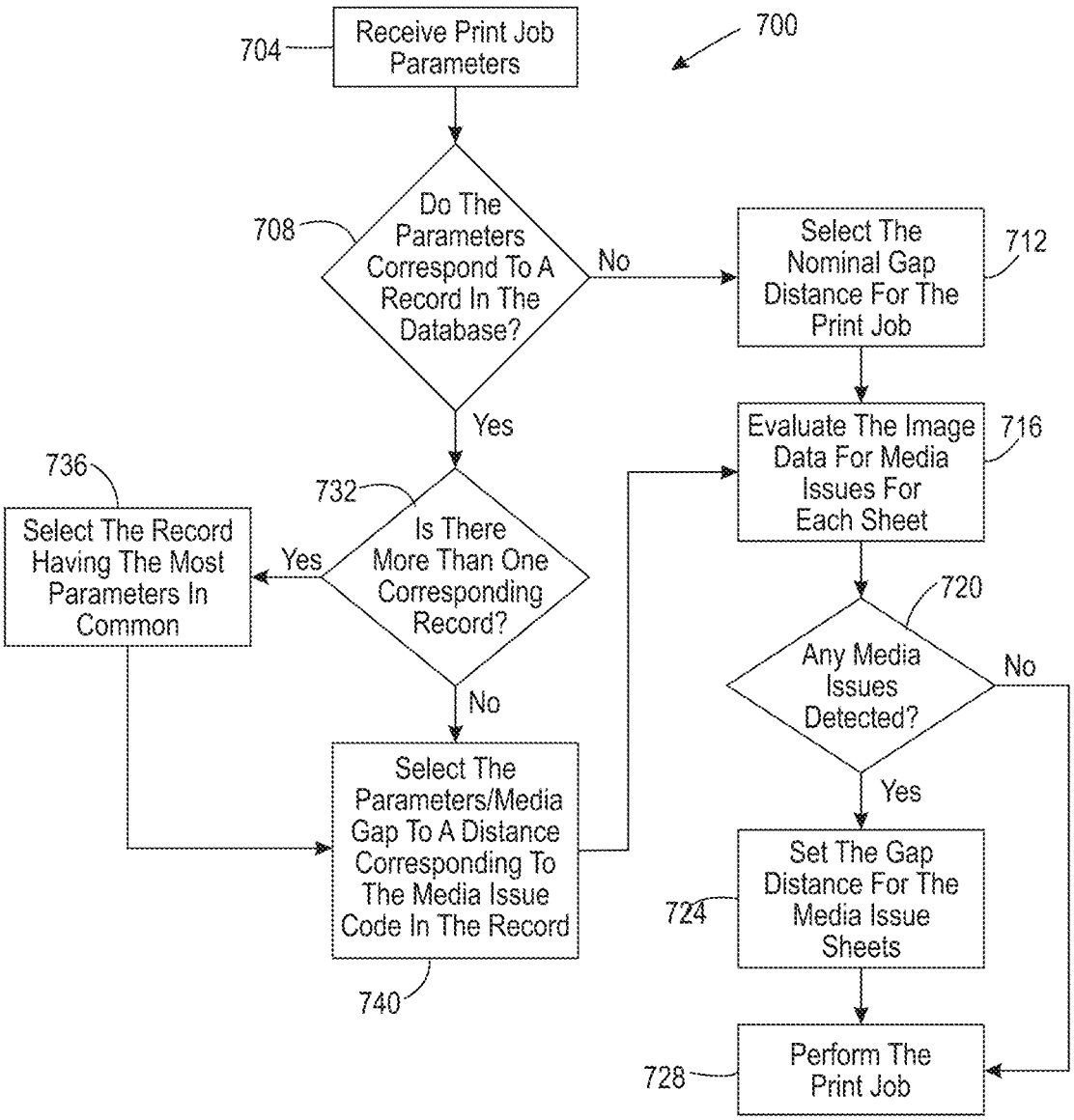
FIG. 7 is a flow diagram of a process for operating the printer of FIG. 1 to evaluate the probability of a media problem during a print job and the options for responding to the problem.

FIG. 7 depicts a flow diagram for a process 700 that operates the printer 10 to adjust the gap between printheads of a module and the media path using print job parameters and the image data for a print job. In the discussion below, a reference to the process 700 performing a function or action refers to the operation of a controller, such as controller 80, to execute stored program instructions to perform the function or action in association with other components in the printer. The process 700 is described as being performed with the printer 10 of FIG. 1 for illustrative purposes.

The process 700 of operating the printer 10 begins with the controller receiving the parameters for a print job (block 704). The print job parameters are compared to records in database 92 to identify records in the database having a majority of job print parameters that correspond to the print job parameters of the current job (block 708). If no records correspond to the print job parameters, then the printhead/media gap is set to the nominal distance for the printer (712) and the image data content for the print job is evaluated for media issues (716). If pages of the print job are evaluated as presenting media issues (block 720), then printhead/media gap distances are selected for each page having media issues (block 724). If no pages presenting media issues are detected, then the print job is performed (block 728) with either the nominal gap distance alone or nominal gap distance for most of the print job and the selected printhead/media gap distances for the pages having media issues. If corresponding records were identified in the database, then the process determines if more than one record was identified (block 732). If more than one record was identified, then the record having the most print job parameters in common with the current print job is selected (block 736). The printhead/media gap distance stored in the selected record is used to set the printhead/media gap distance (block 740). The process then evaluates each page of the image data content for media issues (block 716) and sets the printhead/media gap distance for those pages presenting media issues (blocks 720 and 724). The print job is performed (block 728) with either the gap distance corresponding to the media issue code alone or the media issue code gap distance for most of the print job and the selected printhead/media gap distances for the pages having media issues. In an alternative embodiment of the process, a message is displayed on user interface 50 making the operator aware that the printer will adjust the printhead/media gap distance to one corresponding to a media issue code or for particular pages in the print job unless the operator overrides it before performing the processing of block 728.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating an inkjet printer comprising:

receiving print job parameters for a print job with a controller;

comparing with the controller the received print job parameters with print job parameters stored in records corresponding to previously performed print jobs that are stored in a database;

retrieving records from the database that have at least one print job parameter that corresponds to at least one of the received print job parameters; and adjusting a gap between at least one printhead and a media transport path in the printer using a printhead/media gap distance stored in the retrieved record.

2. The method of claim 1 further comprising:

retrieving a record from the database having a greatest number of print job parameters that correspond to the received print job parameters.

3. The method of claim 2 further comprising:

evaluating image data content received with the print job parameters for pages in the print job having media issues;

identifying a printhead/media gap distance for the pages evaluated to have media issues; and adjusting the gap between the at least one printhead and the media transport to the identified printhead/media gap distance when the pages evaluated to have media issues are printed.

4. The method of claim 3, the evaluation of the image data content further comprising:

determining a number of pixels that need to be printed for a first side of a page in the print job, positions of the pixels, and volumes of ink drops ejected to form the pixels;

moving a sliding window area over the page and identifying a density of ink coverage in the sliding window area as the sliding window area moves over the page; and adjusting the gap between the at least one printhead and the media transport when the page is printed in response to the identified ink density being greater than a predetermined threshold.

5. The method of claim 4, the evaluation of the image data content further comprising:

determining a number of pixels that need to be printed on an opposite side of the page in the sliding window area on the first side of the page, positions of the pixels on the opposite side of the page in the sliding window area on the first side of the page, and volumes of ink drops ejected to form the pixels on the opposite side of the page in the sliding window area on the first side of the page;

identifying the density of ink coverage in the sliding window area on the first side of the page and the opposite side of the page; and adjusting the gap between the at least one printhead and the media transport when the page is printed in response to the identified ink density in the sliding window area on the first side of the page and the opposite side of the page being greater than a predetermined threshold.

6. The method of claim 5 wherein the predetermined threshold corresponds to a probability that wrinkle or cockle occurs if the page is printed using a nominal gap between the at least one printhead and the media transport for a type of media identified by the received print job parameters.

7. The method of claim 6, the adjustment of the gap further comprising:

operating at least one actuator to move a printhead carrier plate to which the at least one printhead is mounted, the printhead carrier plate being moved relative to the media transport.

8. The method of claim 7, the operation of the at least one actuator further comprising:

operating the at least one actuator to move the printhead carrier plate to which the at least one printhead is mounted relative to a nominal position of the printhead carrier plate.

9. The method of claim 7, the operation of the at least one actuator further comprising:

operating a plurality of actuators configured to move the printhead carrier plate relative to the media transport.

10. The method of claim 9 wherein each actuator in the plurality of actuators is positioned at one of four corners of the printhead carrier plate.

11. The method of claim 10 wherein the received print job parameters are comprised of:

media weight, media dimensions, print speed, media type, ink area coverage to be produced on each side of each sheet printed in the print job, location of an image to be produced on each side of each sheet, media color, media fiber orientation for fibrous media, print zone temperature and humidity, media moisture content, and media manufacturer.

12. The method of claim 1 wherein the printhead/media gap distance is a distance between the at least one printhead and the media transport.

13. The method of claim 1 wherein the printhead/media gap distance is a number of steps for a stepper motor to move the printhead carrier plate from a nominal position of a printhead carrier plate.

14. The method of claim 1 wherein the printhead/media gap distance is a number of rotations of a motor to move the printhead carrier plate from a nominal position of a printhead carrier plate.

15. An inkjet printer comprising:

a database in which records corresponding to previously performed print jobs by the inkjet printer are stored;

at least one printhead;

a media transport path that is configured to carry media past the at least one printhead for printing ink images on the media; and a controller operatively connected to the database, the controller being configured to:

receive print job parameters for a print job to be printed by the inkjet printer;

compare the received print job parameters with print job parameters stored in the records of the database;

retrieve records from the database that have at least one print job parameter that corresponds to at least one of the received print job parameters; and adjust a gap between at least one printhead and a media transport path in the printer using a printhead/media gap distance stored in the retrieved record.

16. The inkjet printer of claim 15, the controller being further configured to:

retrieve a record from the database having a greatest number of print job parameters that correspond to the received print job parameters.

17. The inkjet printer of claim 16, the controller being further configured to:

evaluate image data content received with the print job parameters for pages in the print job having media issues;

identify a printhead/media gap distance for the pages evaluated to have media issues; and adjust the gap between the at least one printhead and the media transport to the identified printhead/media gap distance when the pages evaluated to have media issues are printed.

18. The inkjet printer of claim 15, the controller being further configured to evaluate the image data content by:

determining a number of pixels that need to be printed for a first side of a page in the print job, positions of the pixels, and volumes of ink drops ejected to form the pixels;

moving a sliding window area over the page and identifying a density of ink coverage in the sliding window area as the sliding window area moves over the page; and adjusting the gap between the at least one printhead and the media transport when the page is printed in response to the identified ink density being greater than a predetermined threshold.

19. The inkjet printer of claim 18, the controller being further configured to evaluate the image data content by:

determining a number of pixels that need to be printed on an opposite side of the page in the sliding window area on the first side of the page, positions of the pixels on the opposite side of the page in the sliding window area on the first side of the page, and volumes of ink drops ejected to form the pixels on the opposite side of the page in the sliding window area on the first side of the page;

identifying the density of ink coverage in the sliding window area on the first side of the page and the opposite side of the page; and adjusting the gap between the at least one printhead and the media transport when the page is printed in response to the identified ink density in the sliding window area on the first side of the page and the opposite side of the page being greater than a predetermined threshold.

20. The inkjet printer of claim 19 wherein the predetermined threshold corresponds to a probability that wrinkle or cockle occurs if the page is printed using a nominal gap between the at least one printhead and the media transport for a type of media identified by the received print job parameters.

21. The inkjet printer of claim 20 further comprising:

at least one actuator to move a printhead carrier plate to which the at least one printhead is mounted; and the controller is operatively connected to the at least one actuator, the controller being further configured to:

operate the at least one actuator to move the printhead carrier plate relative to the media transport.

22. The inkjet printer of claim 21, the controller being further configured to:

operate the at least one actuator to move the printhead carrier plate to which the at least one printhead is mounted relative to a nominal position of the printhead carrier plate.

23. The inkjet printer of claim 21, the controller being further configured to operate the at least one actuator by:

operating a plurality of actuators configured to move the printhead carrier plate relative to the media transport.

24. The inkjet printer of claim 23 wherein each actuator in the plurality of actuators is positioned at one of four corners of the printhead carrier plate.

* * * * *